United States Patent [19]

Jury

[11] 3,962,763

[45] June 15, 1976

[54] TRUSS-LIKE METAL MEMBER

[76] Inventor: Harold Rex Jury, 23 Kensington Road, Norwood, South Australia

[22] Filed: July 13, 1971

[21] Appl. No.: 162,213

[30] Foreign Application Priority Data

July 16, 1970 Australia ..... 1860/70

[52] U.S. Cl. ..... 29/6.1; 52/635

[51] Int. Cl.[2] ..... E04B 1/18

[58] Field of Search ..... 52/635, 639, 729; 29/6.1

[56] References Cited

UNITED STATES PATENTS

| | | | |
|---|---|---|---|
| 885,158 | 4/1908 | Kahn | 52/670 |
| 1,927,442 | 9/1933 | Laufle | 52/635 |
| 2,052,024 | 8/1936 | Hahn | 52/635 |
| 2,201,504 | 5/1940 | Ruppel | 52/635 |
| 2,913,078 | 11/1959 | Kaiser | 52/635 X |
| 3,034,197 | 5/1962 | Watawabe | 52/635 X |
| 3,099,335 | 7/1963 | Sklar | 52/729 X |
| 3,607,411 | 9/1971 | Brownrigg | 52/635 X |

FOREIGN PATENTS OR APPLICATIONS

| | | | |
|---|---|---|---|
| 138,697 | 1920 | United Kingdom | 52/635 |
| 193,062 | 1924 | United Kingdom | 52/635 |

*Primary Examiner*—Frank L. Abbott
*Assistant Examiner*—Carl D. Friedman
*Attorney, Agent, or Firm*—Jay L. Chaskin

[57] ABSTRACT

The invention relates to the method of forming a truss or truss-like member which has spaced chords interconnected by inclined struts.

The struts are formed by firstly forming a member of constant cross-sectional shape having a web joining the two chords and containing at least one thickened or stiffening portion extending for its length, forming parallel rows of slots with a stiffening portion between each row, the slots of the rows being staggered and overlapping one another, and the chords being moved apart so as to incline the struts formed by those lengths of the stiffening portion which lie between the overlapping portions of the slots, and also to elongate them.

12 Claims, 12 Drawing Figures

TRUSS-LIKE METAL MEMBER

Figure 1:
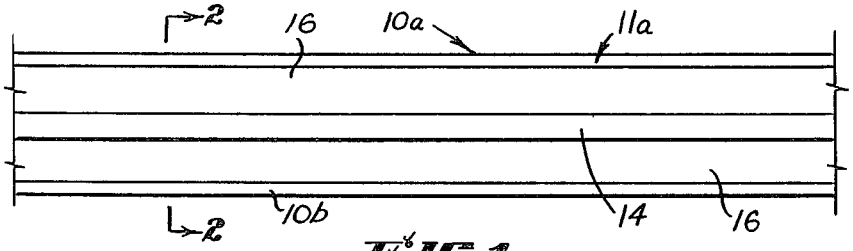

This invention relates to a method of forming a metal member to have outer parallel chords joined by a series of inclined interconnecting members, that is, of a truss-like configuration, and also relates to a member so formed.

It is generally recognised in the art that the greatest rigidity available for a given mass of structural material is available when that structural material is in the form of a truss, that is, a member having a pair of spaced chords, and intermediate members (struts) inclined to the chords and interconnecting them. The art is very well developed and such information is available on the strength of trusses and the structural requirements of each of the elements. It is also known to incorporate intermediate chords for the purpose of stiffening the struts when the struts become of considerable length.

However trusses have been constructed heretofore by the fabrication process, and are particularly cumbersome members to fabricate, and usually handwork has been employed for the construction of trusses. For example trusses are frequently constructed from a pair of spaced parallel flat channel or angle members which constitute outer chords, and a length of rod performed to its final zig-zag shape to constitute the struts between the outer chords, the rod being welded to the inwardly facing surfaces of the outer chords at the localities of the bends in the rod. They have also been made by separately cutting the struts and welding them separately to the outer chords. Both of these methods are in common use, but both of them are subject to the problem that in many instances there is an eccentricity of loading due to failure of the central axes of the struts to intersect one another in the plane of the chords. Furthermore the cost of fabrication is high, particularly if the truss is to be formed from inexpensive non-corrosive materials, for example aluminium, which requires sophisticated and expensive welding techniques.

The main object of this invention is to provide a method of forming a member to provide a truss-like configuration so that the member may be used as a structural member, wherein the above disabilities can be largely reduced, and in some instances, entirely eliminated.

The method of this invention consists of forming a metal member of a truss-like configuration having spaced chords interconnected by a plurality of struts, comprising the steps of:

a. extruding ductile metal to form a member of constant cross-sectional shape with two longitudinally extending chord forming portions and a longitudinally extending outstanding stiffening portion parallel to and between the chord forming portions, b. forming a plurality of longitudinally extending rows of spaced slots in the member, each slot having parallel sides and curved ends, the slots of each row being staggered relative to the respective slots of the next adjacent row and being separated therefrom by said stiffening portion, the centre distance between any two adjacent slots in any one row exceeding the length of each of said adjacent slots but being less than their combined lengths so that the slots of adjacent rows overlap thereby dividing the stiffening portion into a series of strut forming portions, and c. elongating said strut forming portions and moving said chord forming portions apart to thereby elongate said strut-forming portions and form struts and chords, the struts being inclined to the chords. This then makes it possible for the structural member to be formed solely by forming operations, instead of also including a fabricating operation, in turn effecting a considerable cost saving.

A metal member according to this invention, in one of its forms, consists of a truss-like configuration having two spaced outer chords, perforate web portions integral with said spaced outer chords, and stiffening portions integral with said web portions and inclined to said chords thereby forming struts, the web portions being formed by the method of forming a plurality of longitudinally extending rows of equally spaced slots in the web of a member of ductile metal having a constant cross-sectional shape with two longitudinally extending chord forming portions and a stiffening portion parallel to and between the chord forming portions and outstanding from the web, the slots of each row being staggered relative to the respective slots of the next adjacent row and being separated therefrom by the stiffening portion and the centre distance between any two adjacent slots in any one row exceeding the length of each of said adjacent slots but being less than their combined lengths so that the slots of adjacent rows overlap thereby dividing the stiffening portion into a series of strut forming portions, the chords and struts being formed by the method of moving the chord forming portions apart and elongating the strut forming portions and inclining them to the chords.

If the chords are moved apart by different amounts at their ends, thus applying unequal strain to the said struts, a structural member of varying depth is produced.

Figure 2:
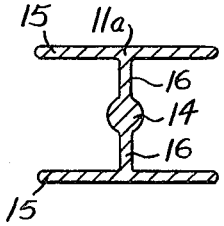
Figure 3:
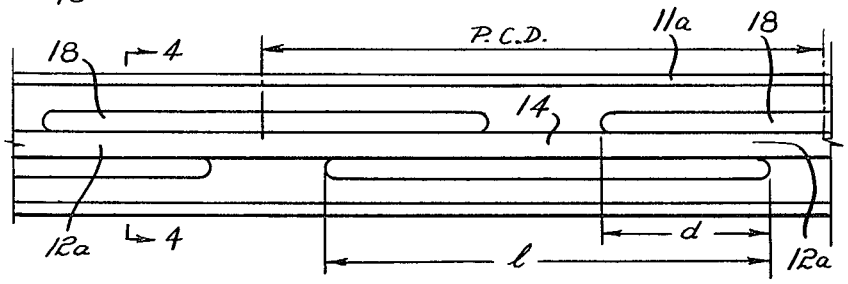
Figure 4:
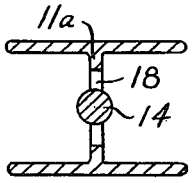
Figure 6:
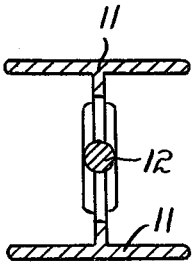
Figure 5:
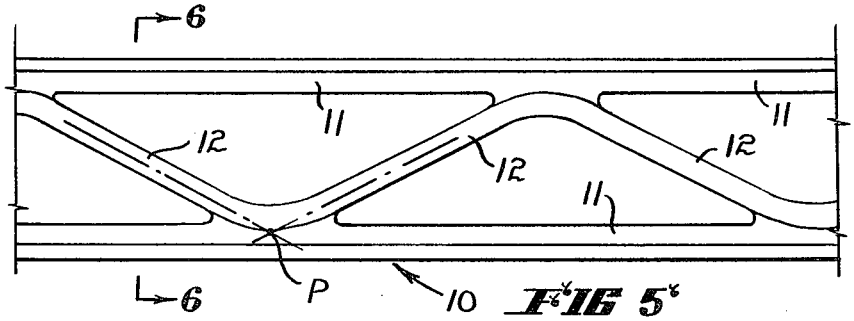
Figure 7:
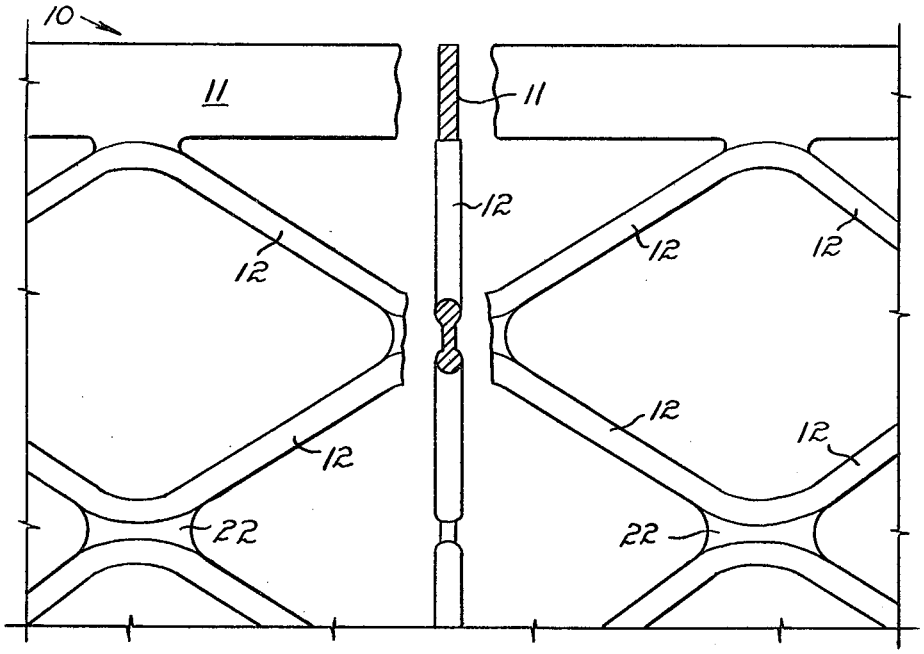
Figure 8:
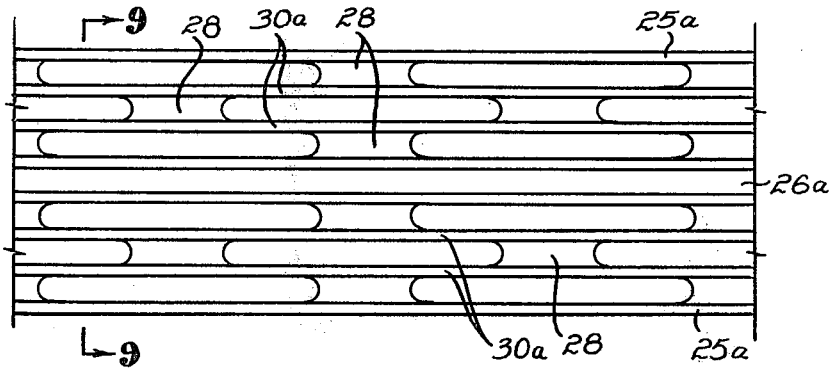
Figure 9:
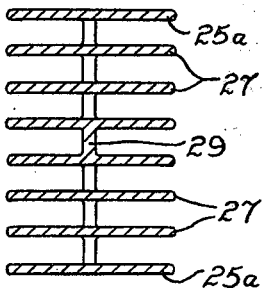
Figure 10:
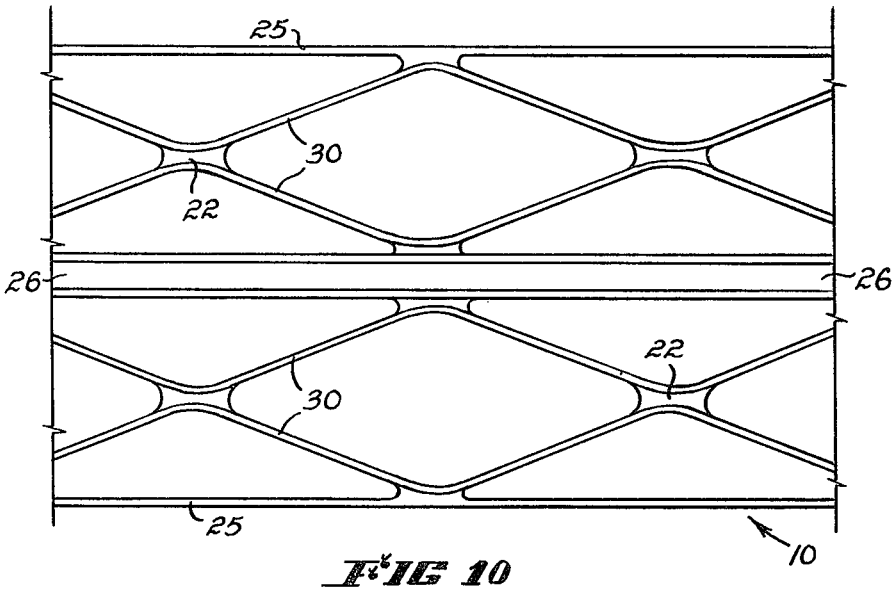
Figure 11:
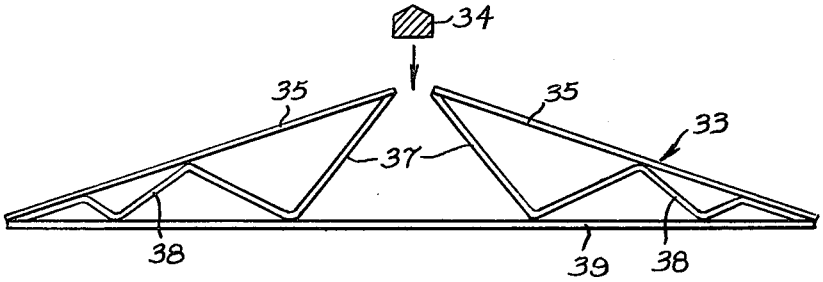
Figure 12:
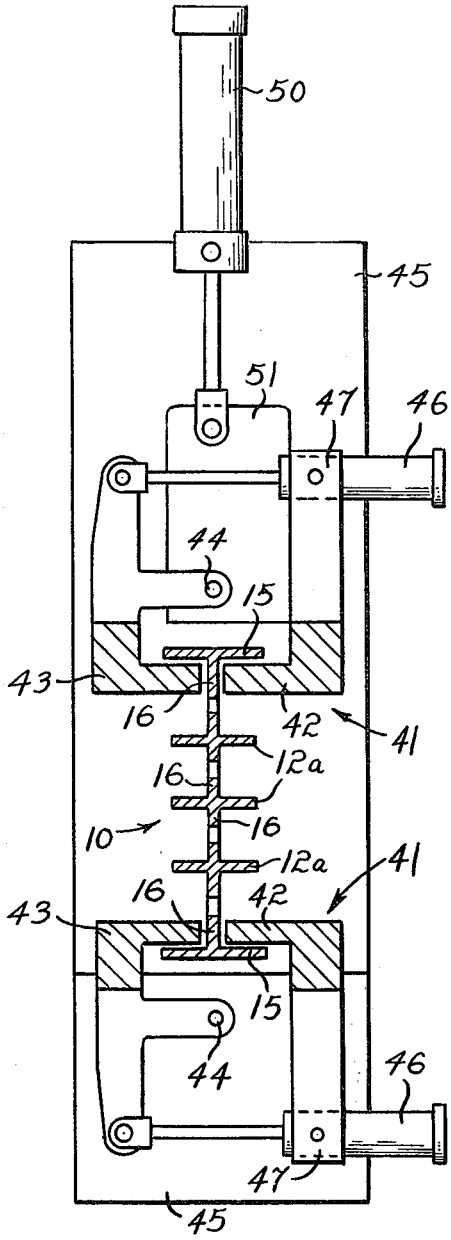

Several embodiments of the invention are described hereunder in some detail with reference to and are illustrated in the accompanying drawings, in which:

FIG. 1 is a fragmentary side elevation of an aluminium extrusion of constant cross-sectional shape, illustrating the product of the first stage in the forming of a metal member of a truss-like configuration, FIG. 2 is a section on line 2—2 of FIG. 1, illustrating a bead constituting a stiffening portion, and flanges constituting chord forming portions, FIG. 3 is a view similar to FIG. 1, but showing the product of a further stage in the forming of the metal member, wherein the extrusion of FIG. 1 contains a plurality of longitudinally extending rows of equally spaced slots, FIG. 4 is a section on line 4—4 of FIG. 3, FIG. 5 is a view similar to FIG. 1, but showing the product of a still further stage, wherein the chords and struts of the member have been formed by the moving apart of the chord forming portions and the elongating of the strut forming portions of the member, FIG. 6 is a section on line 6—6 of FIG. 5, FIG. 7 illustrates a second embodiment, showing a fragmentary side elevation and section of a product formed in the same way as in the first embodiment, the chords however being rectangular sections lying in the plane of the truss, and there being more than two rows of slots so that the struts intersect one another at strut interconnecting zones, FIG. 8 illustrates a third embodiment, and is a fragmentary side elevation showing a stage in the forming of a metal member similar to that illustrated in FIG. 3, but wherein outstanding flanges form the stiffening portions, and wherein there are no apertures between the two central stiffening portions which thereby constitute an intermediate chord forming portion, FIG. 9 is a section on line 9—9 of FIG. 8,

FIG. 10 is a view similar to FIG. 5, showing the product of a further stage, wherein the chords and struts of the member have been formed (as in FIG. 5), FIG. 11 illustrates a fourth embodiment wherein a roof truss has been partly formed by the method of the invention, and FIG. 12 illustrates diagrammatically clamping and stretching means for the elongating of strut forming portions and the moving apart of the chord forming portions.

Referring to the first embodiment of FIGS. 1, 2, 3, 4, 5 and 6, a metal member 10 (FIG. 5) has the configuration of a truss, that is, is provided with a pair of spaced chords 11 interconnected by a plurality of struts 12. This embodiment illustrates a simple form of the invention wherein the chords 11 are parallel and wherein the struts 12 are formed from a single stiffening member which is designated 14 in FIGS. 1, 2, 3 and 4.

FIGS. 1, 2, 3 and 4 show two stages in the forming of the metal member 10, the first stage being illustrated in FIGS. 1 and 2 wherein a member designated 10*a* is formed of constant cross-section from aluminium which conforms to the S.A.E. Standard 6063 (a ductile grade) by an extrusion process. The member 10*a* is provided with chord forming portions 11*a*, the chord forming portions themselves being of T cross-section, comprising flanges 15 and web portions 16, the stiffening member 14 being positioned midway between the flanges 15 and spaced therefrom by the web portions 16.

A further stage in the method of forming the metal member 10 is illustrated in FIGS. 3 and 4 wherein the web portions 16 have a pair of rows of equally spaced slots 18 formed therein, the slots in this embodiment having spaced parallel sides and curved ends as shown in FIG. 3. The existence of the curved ends reduces likelihood of tearing the metal in a subsequent elongating stage when the struts 12 are formed. The slots of the two rows are staggered the centre of each slot of either one row is opposite the midpoint between adjacent slots of the adjacent row. The pitch centre distance, designated "P.C.D.", of the slots of both rows is common, and the length of all slots (designated "l") is also common, but the pitch centre distance exceeds the slot length in every instance but does not exceed double the slot length. In the illustrated embodiment, the pitch centre distance exceeds the slot length by about 25% of the slot length *l* so that the slots of adjacent rows overlap by a distance designated *d* in FIG. 3, the distance *d* then being that length of the stiffening member 14 which is not supported on either of its sides by either of the web portions 16, and constitutes a strut forming portion designated 12*a* in FIG. 3. The length of the strut forming portion 12*a* (the dimension *d*) is more or less, dependent on the length *l* of each slot and the pitch centre distance P.C.D. therebetween, and for example if the pitch centre distance P.C.D. exceeds the Length *l* by 33%, then the unsupported length *d* will be one third of the length of the slot *l*. For most practical purposes the unsupported length *d* is greater than one third of the length of the slot *l*. Products may be formed by the method of this invention with short and widely spaced strut forming portions 12*a*, but if the struts are very short (say less than one quarter of the slot length *l*) then either the intersections of the axes of the struts 12 do not lie close to the neutral axes of the chords 11, or, in the alternative, the chords 11 are moved apart by such a small distance that the advantage of increase in strength is largely lost. The distance *d* cannot of course reach 50% of the length *l*, since at that point the slots become continuous, that is, the chords are completely removed from the stiffening member 14.

After the slots 18 are formed, the spaced chord forming portions 11*a* are moved apart by means of clamps which engage them and which are coupled to power operable means, and this moving apart forms the spaced chords 11 and results in elongating of the strut forming portions 12*a* so as to simultaneously form the struts 12 as illustrated in FIG. 5, and also incline the struts 12 relative to the chords 11. As shown in FIG. 5 the neutral axes of the chords 11 and the projections of the struts 12 are coincident at the point P.

The invention is not limited to metal members having outer flanges, nor to a single stiffening member 14 which forms a single pattern of struts 12 by means of a single continuous member as shown in FIG. 5. Where the required metal member 10 is to have its chords 11 spaced apart by a relatively large distance, further stiffness may be imparted by having a plurality of stiffening members which are interconnected between the chords, this interconnection reducing the danger of buckling of the struts 12 when they are subjected to compressive forces. FIG. 7 illustrates an alternative embodiment wherein the chords 11 are rectangular sections (as shown in the sectioned portion of FIG. 7), and the struts 12 are interconnected by a plurality of interconnecting portions 22. It will be seen that if the struts 12 are of substantially circular cross-section, their buckling will be a function of the least radius of gyration (quarter of the diameter) while the least radius of gyration of the interconnecting portions 22 is determined by the formula $$\frac{T}{\gamma 12}$$

where *T* is the thickness of section. Therefore the least radius of gyration diminishes at the intersecting struts 12, but the effective cross-sectional area is increased so that the danger of buckling is not increased by the existence of this thinner portion.

A third embodiment is illustrated in FIGS. 8, 9 and 10 wherein the metal member 10 is formed with two outer spaced chords 25 and an intermediate chord 26. The stiffening members 27 are all in the form of flanges which stand outwardly from web portions 28, the chord forming portions (FIGS. 8 and 9) designated 25*a* also being outstanding flanges and the intermediate chord forming portion 26*a* comprises a pair of outstanding flanges interconnected by an imperforate web portion 29. Struts 30 are formed from strut forming portions 30*a* (FIG. 8) which are those portions of the stiffening members 27 which are not immediately connected to the web portions 28 on either one of their sides, and which become elongated upon outward movement of the outer chords 25 to provide the configuration shown in FIG. 10, the struts 30 being interconnected by the intersecting portions 22 as in the case of the embodiment described with respect to FIG. 7. This arrangement is load supporting when the struts 30 are placed in compression notwithstanding that the intermediate chord 26 intersects the axes of the struts 30 so that their projections are not continuous through the chord 26.

In the embodiment of FIG. 11, a roof truss 33 has as a separate member a central ridge 34 joined to a pair of upper flanges 35 which slope uniformly downward from the ridge to the extremities of the truss. An aluminium member comprising a single piece of metal is extruded through an extrusion die to have an upper flange, a lower flange spaced from the upper flange and parallel to it, and an intermediate bead positioned midway between the upper and lower flanges, and connected thereto by means of upper and lower webs respectively, as described above with reference to FIGS. 1 and 2.

After extrusion the upper and lower webs are perforated by means of a punching operation to form a pair of rows of slots, but the slots are not equally spaced as in FIG. 3. The slots closest to the centre of the truss member are considerably more widely spaced than those closest to its ends, so that the struts 37 are longer than the struts 38, the difference in length being proportional to the difference in elongation as the struts are formed, so as to stress the struts to a similar amount.

In order to reduce stress concentration, the ends of the perforations are of substantially circular shape as in FIG. 3, and the slots are formed closer to the intermediate stiffening portions than to the respective flanges. This then leaves a T section both for the upper flanges 35 and the lower flanges 39 of the truss, so that the flanges have rigidity of themselves, and thereby resist deflection.

After the extrusion has been formed and the slots formed therein, the upper and lower flanges are positioned in a forming jig which is not illustrated herein, by firmly clamping these flanges in the jig. The clamp restraining the lower flange is in one piece and the clamp restraining the upper flange is in two portions, each portion extending from the ridge position to the extremities. The jig then has its two portions separated from one another under hydraulic pressure, so that the flanges are moved apart and in so moving apart the stiffening portion is strained between the slots, and since the slots are staggered the stiffening portion is strained to form the struts, the ends of the struts however being somewhat curved by the straining operation, so that the projections of the strained struts will in each instance substantially intersect one another in the planes of the neutral axes of the upper or lower flanges respectively.

The two upper clamps which are individually rigid are not moved parallel to the lower flange, the movement of the adjacent ends of the clamps exceeding that of the outer ends, thus providing a truss of varying depth. To prevent the force required to displace the top flange over straining the outer struts, adjustable stops restrain the outer ends of the clamps against excessive movement.

In order to achieve the elongation of the strut forming portions so as to form struts, when the chords are parallel, use is made of a device as illustrated in FIG. 12 wherein a metal member 10 having a plurality of strut forming portions 12*a* outstanding from web portions 16 and having flanges 15 arranged to form portions of their respective outer chords, is positioned in a device having two pairs of hydraulically operated clamp jaws 41. The clamp jaws designated 42 are fixed jaws and those designated 43 are arranged to pivot about respective pivots 44. The lower of the fixed jaws is secured to the main frame 45. Respective hydraulic cylinders 46 are trunnion mounted to brackets 47 and are coupled to respective pivot clamp jaws 43 so that the web portions 16 of the metal member 10 may be very firmly clamped. An elongating cylinder 50 is coupled to a movable frame 51 which carries the upper pair of clamp jaws 41, the elongating cylinder 50 being trunnion mounted on the main frame 45. As the cylinder 50 operates, the outer chord forming portions are moved away from one another to thereby stretch the strut forming portions 12*a* and thus form the struts 12 to make a product which has a truss-like configuration.

Consideration of the above embodiments will indicate that the invention is useful for producing a member which may be used as a truss, having considerable rigidity and resistance to deflection in the direction of the plane which contains all the struts. However the invention is not limited to load bearing members with a load applied in this manner, and for example a load may be applied in a transverse direction on a metal member having the configuration illustrated in FIG. 10. The existence of the intermediate chord 26 adds considerably to the lateral strength of such a member, and the metal member may be used as a walk-way if a series of intermediate chords are used. Furthermore the invention may be applied at low cost to members having considerable distance between their outermost chords. If the outer chords are of deep section, a trough-like member may be formed, the struts forming the base of the trough. Such a member is useful as a cable trough.

While ductile aluminium is an excellent material for use in this invention, it may also be applied to steel members, or members of other ductile metal. Various modifications and equivalents to the embodiments disclosed herein, as determined by the skill of the art, are within the scope of this invention as recited in the claims.

When designing a load bearing truss to be made in accordance with this invention, special care should be taken to ensure that both the chords and the struts have adequate cross-sectional area and suitable shape to resist buckling, and it is considered prudent to allow a higher factor of safety than with conventional trusses because of the complex nature of the stresses within the strained metal.

What I claim is:

1. A method of forming a metal member of a truss-like configuration having spaced chords interconnected by a plurality of struts, comprising the steps of:

a. extruding ductile metal to form a member of constant cross-sectional shape with two longitudinally extending chord forming portions and a longitudinally extending outstanding stiffening portion parallel to and between the chord forming portions, b. forming a plurality of longitudinally extending rows of spaced slots in the member, each slot having spaced parallel sides and curved ends, the slots of each row being staggered relative to the respective slots of the next adjacent row and being separated therefrom by the stiffening portion, the centre distance between any two adjacent slots in any one row exceeding the length of each of said adjacent slots but being less than their combined lengths so that the slots of adjacent rows overlap thereby dividing the stiffening portion into a series of strut forming portions and forming between the adjacent slots a series of web portions, each strut forming portion having respective least radii of gyration of cross-sectional shape which exceed the least radius of gyration of cross-sectional shape of each web-forming portion but the effective cross-sectional area of each web-forming portion exceeding the cross-sectional area of each strut-forming portion sufficiently to compensate for its reduced radius of gyration when subjected to buckling loads, c. clamping substantially only respective chord forming portions along their longitudinal extent in an elongation means, and d. operating said elongation means so as to move said clamped chord forming portions apart to elongate said strut forming portions and form struts and chords, the struts being inclined to the chords.

2. The method of forming a metal member according to claim 1 wherein said chords are moved apart by different distances along their lengths to form a truss of varying depth.

3. The method of forming a metal member according to claim 2 wherein both the lengths of the slots and the lengths of the strut forming portions are greater at the localities where the chord forming portions are moved apart to become more widely separated than at the localities where the chord forming portions are moved apart to become less widely separated.

4. The method of forming a metal member according to claim 1 wherein said chord forming portions remain parallel as they are moved apart so as to form a metal member having spaced parallel chords.

5. The method of forming a metal member according to claim 4 wherein the lengths of the slots are the same in all rows, and wherein the slots are equally spaced in all rows.

6. The method of forming a metal member according to claim 4 wherein the struts are elongated by straining them beyond their yield point, and are simultaneously inclined to the chords, by the moving apart of the chord forming portions.

7. The method of forming a metal member according to claim 1 wherein said chord forming portions include flanges, a web extending between the flanges, and each said stiffening portion is outstanding from the web.

8. The method of forming a metal member according to claim 7 wherein said slots are punched in the web and thereby form the series of web portions.

9. The method of forming a metal member according to claim 7 wherein each said stiffening portion is formed as a bead having portions thereof outstanding from opposite sides of the web.

10. The method of forming a metal member according to claim 7 wherein each said stiffening portion is formed as a flange having portions thereof outstanding from opposite sides of the web.

11. The method of forming a metal member according to claim 1 wherein said member of constant cross-sectional shape is formed with a plurality of stiffening portions outstanding from the web, said stiffening portions being parallel to one another, said slots forming the web into interconnecting portions, each interconnecting portion joining four struts after the moving apart of said chord forming portions.

12. The method of forming a metal member according to claim 11 wherein each group of interconnected four struts comprise two aligned pairs of neutral axes of which intersect in the interconnecting portion.

* * * * *